US005159895A

United States Patent [19]

Helling et al.

[11] Patent Number: 5,159,895

[45] Date of Patent: Nov. 3, 1992

[54] PACKAGED ARTICLE ASSEMBLY

[76] Inventors: Robert W. Helling, 11214 Quivas Way, Westminster, Colo. 80234; Daniel J. Helling, 8288 Pecos St., Denver, Colo. 80221; Dean V. Rogers, 9330 N. County Rd. 15, Fort Collins, Colo. 80524

[21] Appl. No.: 734,474

[22] Filed: Jul. 23, 1991

Related U.S. Application Data

[62] Division of Ser. No. 550,099, Jul. 9, 1990, Pat. No. 5,035,104.

[51] Int. Cl.[5] ..... A01K 63/02; B65B 23/00; B65B 55/20; B65B 53/00

[52] U.S. Cl. ..... 119/3; 206/584; 53/556; 53/472; 53/441

[58] Field of Search ..... 119/3; 53/441, 385.1, 53/584, 472, 434, 556; 206/584

[56] References Cited

U.S. PATENT DOCUMENTS

| | | | |
|---|---|---|---|
| 2,815,621 | 12/1957 | Carter | 53/434 |
| 3,350,838 | 11/1967 | Rodrigues | 53/472 |
| 3,999,653 | 12/1976 | Haigh et al. | 206/584 |
| 4,955,412 | 9/1990 | Younts et al. | 53/385.1 |
| 4,974,393 | 12/1990 | Rich et al. | 53/441 |

FOREIGN PATENT DOCUMENTS

| | | | |
|---|---|---|---|
| 8910315 | 11/1989 | World Int. Prop. O. | 206/584 |

*Primary Examiner*—John G. Weiss

*Attorney, Agent, or Firm*—Fields, Lewis, Pittenger & Rost

[57] ABSTRACT

A method of packaging articles and packaged article assemblies disclosed includes inflating a body such as a latex balloon or a bag with a drawstring preferably by evacuating the air in a chamber surrounding the body while the body is supported and sealed at the fill opening. An initial selected quantity of packaging particles are placed inside the inflated body followed by placing the article therein. The body is collapsed around the particles which distributes them in a substantially uniform layer surrounding the article from all sides and applies compressive forces inwardly from all sides to cushion the article in the body. Another method involves expanding an outer body, placing packaging particles in that body, collapsing that outer body and placing a second body in the outer body followed by expansion of the two and putting a fluid and article in the inner body and sealing the bodies closed. The resulting packaging assembly has an inner body with fluid such as water and preferably a live fish with a layer of particles compressed against the inner body by an outer collapsed body for transporting live fish and the like.

8 Claims, 2 Drawing Sheets

PACKAGED ARTICLE ASSEMBLY

This is a divisional application of Ser. No. 07/550,099 filed Jul. 09, 1990, now U.S. Pat. No. 5,035,104.

TECHNICAL FIELD

This invention relates to packing or packaging articles for transportation and particularly those articles that are easily damaged.

BACKGROUND ART

There are many types of objects which require special packing or packaging for shipment which include both fragile and perishable articles. The packaging requires protection against shock, breakage, impact and vibration. Dunnage particles heretofore used are flexible, yielding and resilient to support the object so as to be protected against heavy or severe impact during shipment.

Simon U.S. Pat. No. 2,897,641 teaches packaging methods which involve the use of protective sheaths or shells of cellular plastic wherein a fragile article is first placed in a bag along with a mass of soft yielding material, such as ground sponge rubber, excelsior, etc., and then the bag and its contents are completely enclosed within a foamed inner sheath which in turn is encased within a foamed outer sheath.

Dolinar U.S. Pat. No. 4,644,733 discloses loose fill dunnage or packing material and the use of such material for packaging whereby a container for an article is slightly over-filled with these particles so that upon closing the container the particles become slightly compacted.

Ambrose U.S. Pat. No. 4,267,684 and Aninger U.S. Pat. No. 3,398,501 disclose an inflated outer envelope that is expanded about an article in an inner envelope.

BRIEF DESCRIPTION OF THE DRAWINGS

Details of this invention are described in connection with the accompanying drawings which like parts bear similar reference numerals in which.

DETAILED DESCRIPTION

Figure 1:
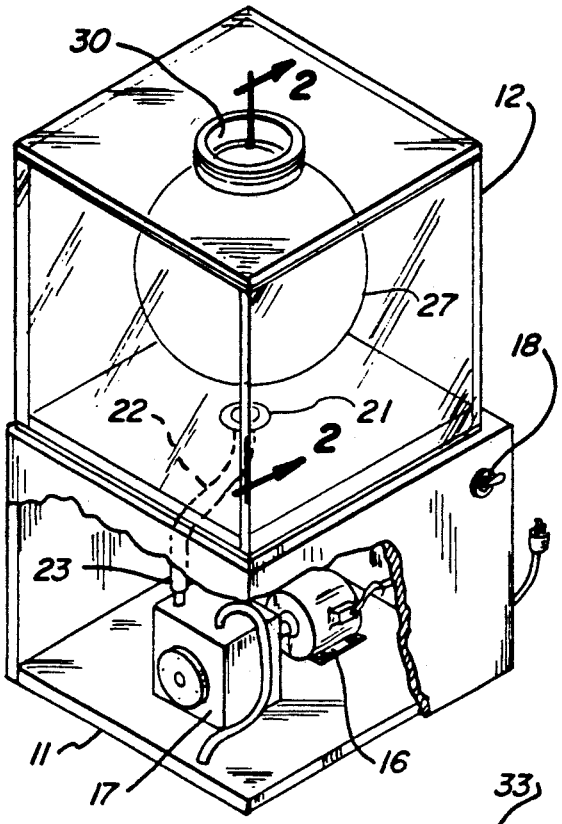
FIG. 1 is a top perspective view of apparatus for inflating or expanding an inflatable body with exterior parts broken away to show interior construction.
Figure 2:
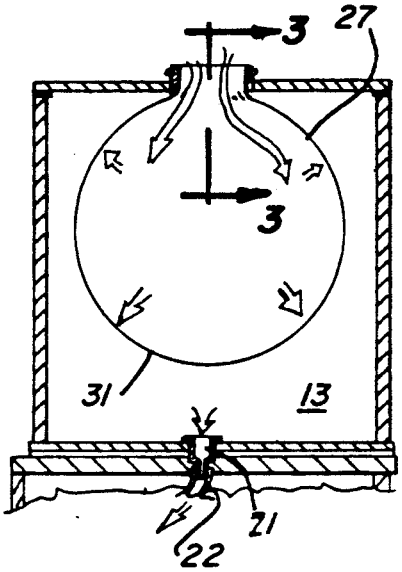
FIG. 2 is a sectional view taken along line 2—2 of FIG. 1.
Figure 3:
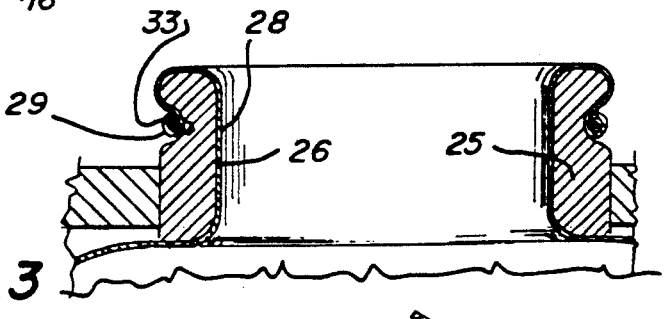
FIG. 3 is an enlarged sectional view taken along line 3—3 of FIG. 2.

Referring now to the drawings, the inflating apparatus shown includes a lower base 11 on which there is mounted an upper housing 12 preferably made of transparent walls for viewing the interior and defining a sealed or gas-tight evacuation chamber 13. The top wall 14 is readily removable from the sidewalls or hingedly connected along one edge to a sidewall to pivot up to enable the removal of packaged article assemblies from the chamber 13. The lower housing 11 contains a conventional electric motor 16 and an air pump 17 driven by the motor and arranged so that upon actuation of the motor and rotation of the pump as by actuating electric switch 18 electrically connected to the motor 16, the air is drawn from port 21 in the bottom of the chamber through a hose 22 to an inlet port 23 in the pump thereby evacuating the chamber 13.

A hollow annular fill hub 25 is mounted in the top wall 14 of the upper housing providing an access passage 26 via the hub into the evacuation chamber 13. An inflatable, expandable, gas-imperforate body 27 shown in the form of a conventional latex balloon is mounted on the fill hub. It is understood other shapes of inflatable bodies can be used. The body 27 shown has a narrower neck portion 28 that terminates at one end in a bead portion 29 which bead portion and neck portion define an opening 30 into the inside of the body 27. The bead portion 29 is typically formed by rolling the end of the neck portion back on itself to provide multiple layers. The body shown has a generally spherical main body portion 31 opposite the fill opening 30.

In installing a body 27 for inflation, the main body portion 31 is inserted through the hub 25 and down into the chamber 13 and the neck portion 28 is everted back over the fill hub 25 and the bead portion 29 is placed in an outer annular groove 33 in the fill hub 25 to form an air-tight seal. The body expands and becomes inflated due to the reduced pressure in the evacuation chamber which is less than atmospheric pressure.

Figure 4:
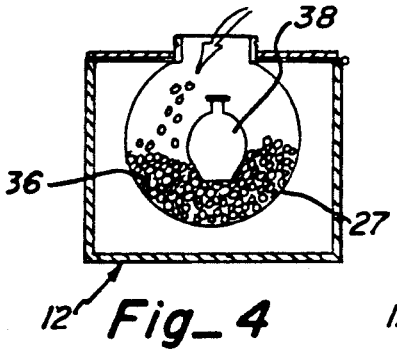
FIG. 4 is a sectional view showing the expanded body partially filled with a quantity of packaging particles and an article positioned on the particles.
Figure 5:
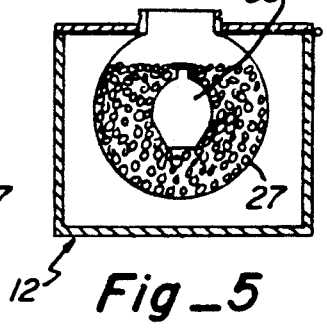
FIG. 5 is a sectional view showing the inflatable body filled with additional particles before being collapsed.
Figure 6:
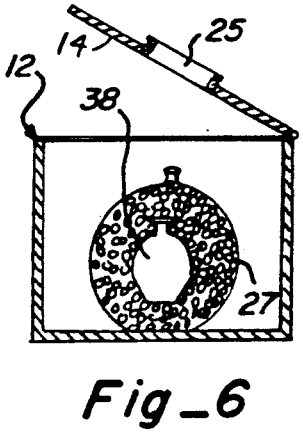
FIG. 6 is a sectional view showing the packaged article assembly including the collapsed body containing the article and surrounding layer of particles that has been removed from the fill hub with the top wall in a raised position for removal of the assembly from the chamber.

In the method according to the present invention, after the body 27 is mounted on the fill hub and expanded as above described, an initial selected quantity of packaging particles 36 are inserted into the body through the fill opening 30. An article 38 to be shipped, such as glassware, is placed on the packaging particles as shown in FIG. 4. A further selected quantity of the particles is inserted. The further quantity is sufficient to entirely surround the article with a layer of particles of substantially uniform thickness when the body is collapsed about said layer and article. The body is then collapsed by stopping the motor to remove the evacuation pressure in the chamber. The collapsing of the generally spherical body by removing the vacuum pressure causes the particles to form a layer of particles of substantially uniform thickness surrounding the article on all sides and applies substantially uniform inwardly directed compressive forces from all sides to compress the particles against the article and cause a frictional engagement of particles against the article and against one another to cushion the article therein. This packaged article assembly has been found to be highly effective in protecting the article against impact as by dropping and the like.

Figure 7:
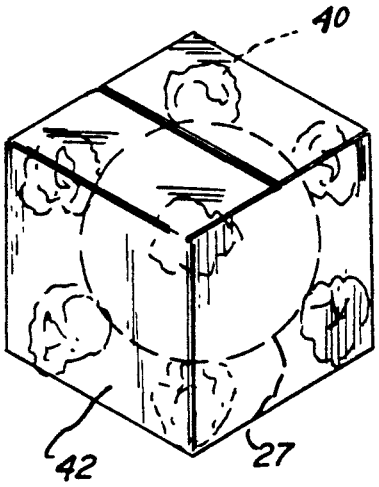
FIG. 7 is a perspective view showing the packaged article assembly of FIG. 6 disposed in a shipping container with a fill material between the two.

The neck portion of the body may be tied or not tied or otherwise closed as with a knot or closure as this is optional. The packaged article assembly comprised of the contracted body 27 with article 38 and layer of particles shown in dashed lines in FIG. 7 preferably is then placed in a shipping box 42 for shipment. Preferably a filler material 40 such as crumpled newspaper is placed between the contracted assembly and the inside of the box 42.

The packaging or dunnage particles 36 suitable for use for the method herein described are of the type used in current packaging applications and may be shredded or wadded paper, wood shavings, plastic foam granules, ground sponge rubber, cotton linters and the like. These materials exhibit the characteristics of being soft, yielding, as well as light weight, low density and provide a firm holding and cushioning effect for the article in the collapsed balloon body. The foam plastic granules are typically peanut-like in size and shape.

Figure 8:
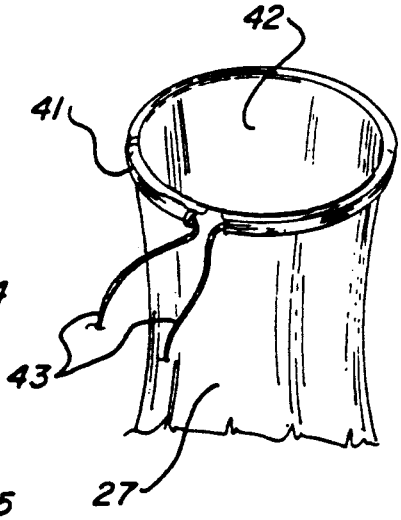
FIG. 8 is a sectional view of another form of inflatable body using a drawstring for closing the top opening around a fill hub.

Referring now to FIG. 8 there is shown another form of inflatable, gas-imperforate body 27*a* that is of a bag-like form having an opening 42 at least as large as the main body portion and further has a hollow tubular encasement or tubing 41 defining the opening 42 into the body with a drawstring 43 inside the tubing. This body 27*a* has the ability to receive larger articles due to a larger opening 42 into the body and not having a restricted neck portion. In use, the open end portion is fitted around the fill hub 25 and drawn tightly thereabout to contract the fill tubing into the recess 33 of the fill hub by drawing down the drawstrings 43 to form an gas-tight seal.

Figure 9:
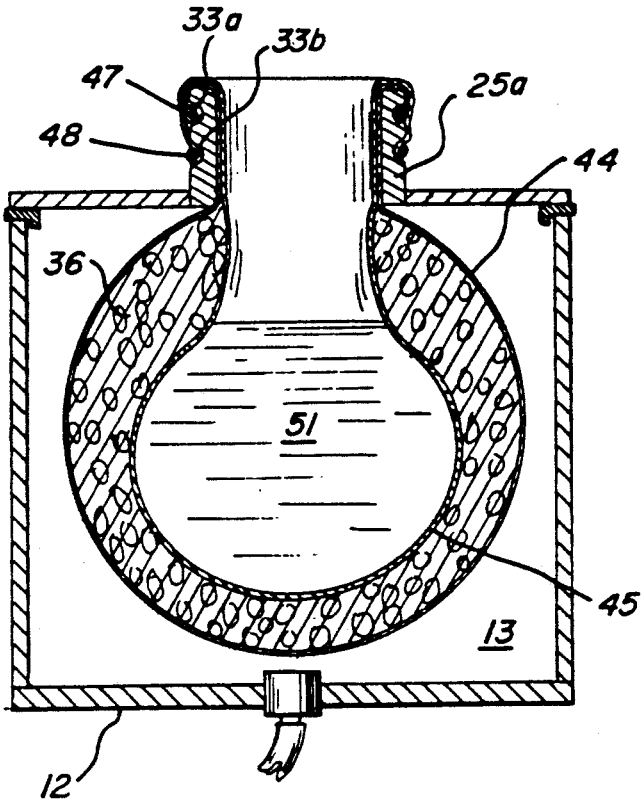
FIG. 9 is a sectional view of another embodiment of the present invention using two inflatable bodies shown in an inflated condition in the apparatus with a layer of packaging particles between the two and the inner body containing a fluid.
Figure 10:
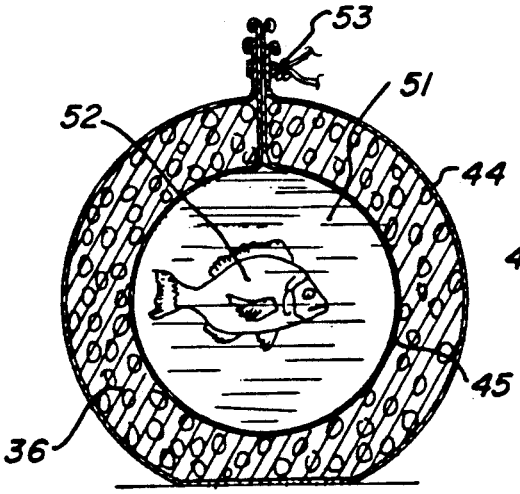
FIG. 10 is a sectional view showing the arrangement of FIG. 9 in a collapsed body condition and the neck portions of the collapsed bodies tied closed and sealed.

Referring now to FIGS. 9 and 10, there is shown the upper housing 12 with a top hub 25*a* having a first annular groove 33*a* and a second annular groove 33*b*. For forming a dual layer assembly a first inflatable body 44 such as a latex balloon as shown is placed inside the chamber 13 and the neck portion everted and the end bead portion of the first body is placed in groove 33*a* . The chamber 13 is evacuated to expand body 44. A selected quantity of packaging particles 36 is placed inside the first body 44. The evacuation pressure is removed and the first body is partially collapsed. A second inflatable body 45, such as another latex balloon, is inserted through the hub and into the first body 44 and the neck is everted over the first body with its bead portion fitting into groove 33*b*. The first and second bodies are expanded causing the particles between the two bodies to spread out and fill the space between the two to form a layer of particles of substantially uniform thickness. A selected quantity of fluid 51 placed within the inner second body 45 and one or more articles to be shipped, such as live fish 52, can be placed therein for shipment. Typically, oxygen pills will also be added to the fluid 51 to sustain the fish. The openings of both bodies are closed as by using a tie line 53 tied in a knot so as to seal the inside of the bodies from the outside. If the bodies have drawstrings they are drawn tightly as above described. The assembly of collapsed bodies and separating layer of particles can then be placed in a suitable shipping box 42 as was above described in connection with FIG. 7.

Although the present invention has been described with a certain degree of particularity, it is understood that the present disclosure has been made by way of example and that changes in details of structure may be made without departing from the spirit thereof.

What is claimed is:

1. A packaged article assembly comprising:

an article, a plurality of packaging particles forming a layer entirely surrounding said article, and a flexible body surrounding said particles, said body being collapsed around said particles to apply substantially uniform compressive forces from all sides to compress said particles against said article and cause a frictional engagement of particles against said article and against one another to cushion said article within said body.

2. A packaged article assembly as set forth in claim 1 wherein said packaging particles are of a relatively light weight, low density and yielding under pressure.

3. A packaged article assembly as set forth in claim 1 wherein said flexible body is in the form of a flexible latex balloon with a narrower neck portion between a generally spherical main body portion and a bead portion defining a fill opening at the end of said neck portion opposite said main body portion.

4. A packaged article assembly as set forth in claim 1 wherein said body is of bag-like form having drawstring means in a tubular body portion at an end of the body defining said fill opening to selectively contract said fill opening.

5. A packaged article assembly as set forth in claim 1 wherein said packaging particles are a plastic foam material and are peanut-like in size and shape.

6. A packaged article assembly as set forth in claim 2 wherein said body surrounding said article is generally spherical and said layer of particles conform to the interior surface of said body and is of substantially uniform thickness in the radial direction.

7. A packaged article assembly comprising:

a closed, inner body containing a fluid and an article, a layer of a plurality of packaging particles forming a layer surrounding said inner body, and a closed, outer flexible body surrounding said particles, said body being collapsed around said particles and inner body to apply substantially uniform compressive forces from all sides to compress said particles against said inner body and cause a frictional engagement of particles against said article and against one another to cushion said fluid and article within said bodies.

8. A packaged article assembly as set forth in claim 7 wherein said inner body is flexible.

* * * * *